US007006054B2

(12) United States Patent
Rosenfeld et al.

(10) Patent No.: US 7,006,054 B2
(45) **Date of Patent: *Feb. 28, 2006**

(54) ANTENNA AND RADIO INTERFACE

(75) Inventors: Dennis Rosenfeld, Meriden, CT (US); Robert Hathaway, Ivoryton, CT (US); Adrian T. Utrilla, Litchfield, CT (US)

(73) Assignee: Radio Frequency System, Inc., Meriden, CT (US)

( * ) Notice: Subject to any disclaimer, the term of this patent is extended or adjusted under 35 U.S.C. 154(b) by 14 days.

This patent is subject to a terminal disclaimer.

(21) Appl. No.: 10/730,992

(22) Filed: Dec. 10, 2003

(65) Prior Publication Data

US 2004/0136778 A1 Jul. 15, 2004

Related U.S. Application Data

(62) Division of application No. 09/985,383, filed on Nov. 2, 2001, now Pat. No. 6,685,383.

(51) Int. Cl.
*H01Q 1/50* (2006.01)

(52) U.S. Cl. ..... 343/906; 343/872

(58) Field of Classification Search ..... 343/702, 343/906, 872

See application file for complete search history.

(56) References Cited

U.S. PATENT DOCUMENTS

| | | | |
|---|---|---|---|
| 2,496,928 | A | 2/1950 | Bing et al. |
| 2,524,995 | A | 10/1950 | Sassano |
| 3,232,644 | A | 2/1966 | Pfeifer |
| 3,427,552 | A | 2/1969 | Sauer |
| 3,560,981 | A | 2/1971 | Pestka |
| 3,633,151 | A | 1/1972 | Sensabaugh |
| 3,636,412 | A | 1/1972 | Simovits et al. |
| 3,778,832 | A | 12/1973 | Carruthers |
| 3,946,390 | A | 3/1976 | Alexander et al. |
| 3,969,728 | A | 7/1976 | Hodsdon et al. |
| 4,065,092 | A | 12/1977 | Spinks, Sr. et al. |
| 4,173,761 | A | 11/1979 | Liautaud |

(Continued)

*Primary Examiner*—Shih-Chao Chen
(74) *Attorney, Agent, or Firm*—V. Lawrence Sewell; Sughrue Mion, PLLC

(57) ABSTRACT

A novel locking mechanism for mounting a radio to an antenna. The mounting face of a radio is secured to the mounting portion of an antenna. The mounting portion of the radio has a locking ring on which a plurality of radio locking tabs are located at equally spaced positions. The ring can be fixed to the radio, or in another embodiment, is still secured to the radio but can rotate independently. The mounting portion of the antenna has a corresponding number of equidistantly spaced tension springs, which have a plurality of spring fingers. To mount the radio to the antenna, the radio locking ring with radio locking tabs is twisted so that each antenna tension spring is deflected by a corresponding radio locking tab. The engagement of the radio locking ring to the antenna spring fingers secures the radio to the antenna. The deflection force also produces a friction force. The spring fingers allow the deflection and friction forces between the tension spring and radio locking tab to increase step-wise when the radio locking ring is brought into contact with each additional spring finger. This step increase in forces allows a user, when turning the radio, to overcome the forces of each spring finger individually, instead of having to initially overcome both sum forces of one solid spring. When the adaptation of the rotating ring is used and additional polarization feature, is possible that prevents the incorrect polarization installation of the radio and antenna assembly by the user.

6 Claims, 6 Drawing Sheets

U.S. PATENT DOCUMENTS 4,190,839 A 2/1980 Liautaud
4,431,333 A 2/1984 Chandler
4,468,671 A 8/1984 Ellingson et al.
4,538,967 A 9/1985 Furukawa
4,726,534 A 2/1988 Chenoweth
4,755,822 A 7/1988 Chesebro
4,779,516 A 10/1988 Parker et al.
5,198,832 A 3/1993 Higgins et al.
5,218,369 A 6/1993 Jennings
5,576,720 A * 11/1996 Gorenz et al. ..... 343/702
5,714,963 A 2/1998 Cox
5,936,581 A 8/1999 Roshitsh et al.
5,949,386 A * 9/1999 Elliott ..... 343/906
6,061,229 A 5/2000 Gates et al.
6,157,350 A * 12/2000 House et al. ..... 343/906
6,292,142 B1 9/2001 Pittman
6,322,284 B1 11/2001 Bonordo et al.
6,469,678 B1 * 10/2002 Pullen ..... 343/888
6,509,878 B1 * 1/2003 Tornatta et al. ..... 343/715
6,518,928 B1 * 2/2003 Sheu ..... 343/702
2002/0105475 A1 8/2002 Overton et al.

* cited by examiner

ANTENNA AND RADIO INTERFACE

This is a divisional of application Ser. No. 09/985,383, filed Nov. 2, 2001 now U.S. Pat. No. 6,685,383; the disclosure of which is incorporated herein by reference.

FIELD OF THE INVENTION

The present invention generally relates to simplified device and method for securing a radio to an antenna.

BACKGROUND OF THE INVENTION

There are a number of existing ways to mount a radio, i.e. the transmitter/receiver portion of a communication system, to an antenna. High securing forces are desirable for mounting a radio to an antenna because these forces counteract the effect of shock and vibration loads caused by external forces such as wind. Some existing mounting systems use sets of individually installed latches, while others use bolts. The latches are typically manually operated and provide only a limited total compression per latch. While bolts can provide much greater compression loads, they must be individually installed and tightened. Therefore, a device that provides greater deflection and friction forces and simplicity of installation is needed.

U.S. Pat. No. 3,633,151 teaches a combined mechanical fastener and electrical connector with tabs that are rotated to engage circumferential locking members. These fasteners, however, do not provide variable deflection and friction forces. Therefore, they cannot provide the high deflection and friction forces needed to mount a radio to an antenna, while at the same time enabling a user to overcome these forces when fastening the device.

SUMMARY OF THE INVENTION

This invention is a novel locking mechanism for mounting a radio to an antenna. The mounting face of a radio is secured to the mounting face of an antenna. The radio has a locking ring, on which a plurality of locking tabs are located at equally spaced positions. The antenna has a corresponding number of equally spaced tension springs assemblies, which are made up of a plurality of spring fingers.

To mount the radio to the antenna, the radio locking ring with locking tabs is twisted so that each tension spring finger is deflected by a corresponding locking tab. This deflection force produces a friction force that secures the radio to the antenna.

The use of spring fingers creates a variable force tension spring. The spring fingers allow the deflection and friction forces between the tension spring and locking tab to increase step-wise when the locking tab is brought into contact with each additional spring finger. This step increase in the forces allows a user, when turning the radio, to overcome the sum of forces of each spring finger individually, instead of having to overcome the entire sum of forces of one solid spring. Therefore, it is easier to mount the antenna to the radio using the individual spring fingers than it would be with one-piece tension springs.

The locking ring of the invention can be either fixed to the radio or rotatably attached to the antenna. Having a rotatable ring allows the radio to remain stationary during the installation of the radio to the antenna. If it is rotatably attached, the proper polarization of the radio antenna system can be assured by employing a polarization pin.

BRIEF DESCRIPTION OF THE DRAWINGS

The advantages, nature and various additional features of the invention will appear more fully upon consideration of the illustrative embodiment of the invention which is schematically set forth in the drawings, in which.

DETAILED DESCRIPTION OF THE INVENTION

The preferred embodiment of the invention will be explained in further detail by making reference to the accompanying drawings, which do not limit the scope of the invention in any way. The invention relates to a twist-lock mounting arrangement for securing a radio 10 to an antenna 20.

Mounting Arrangement

Figure 1:
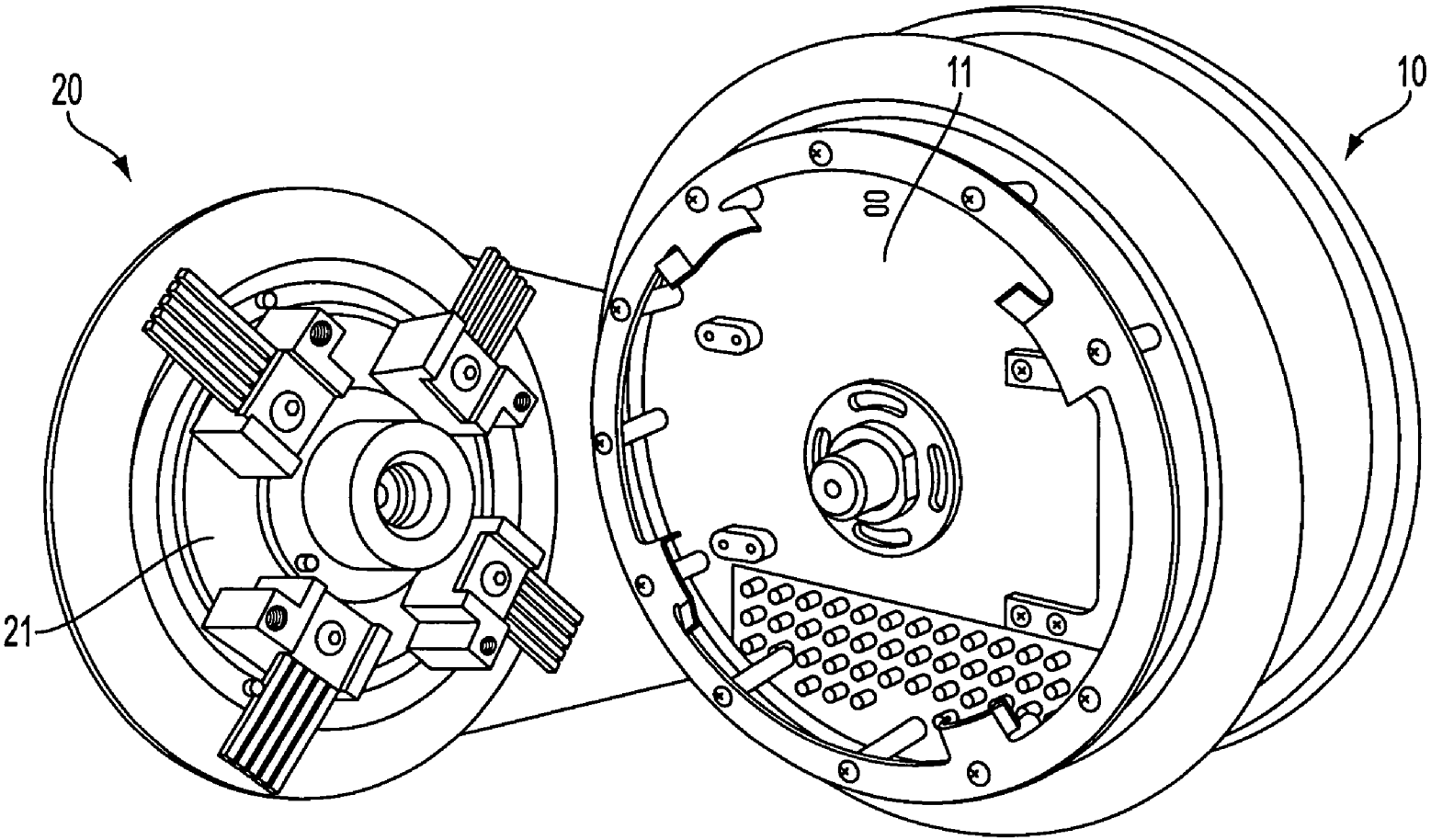
FIG. 1 is a three dimensional view of the mounting arrangement including the radio and the antenna mounting face.

Referring to FIG. 1, the mounting arrangement according to a preferred embodiment includes a radio 10 with a radio mounting face 11 and an antenna 20 with an antenna mounting face 21.

Figure 2:
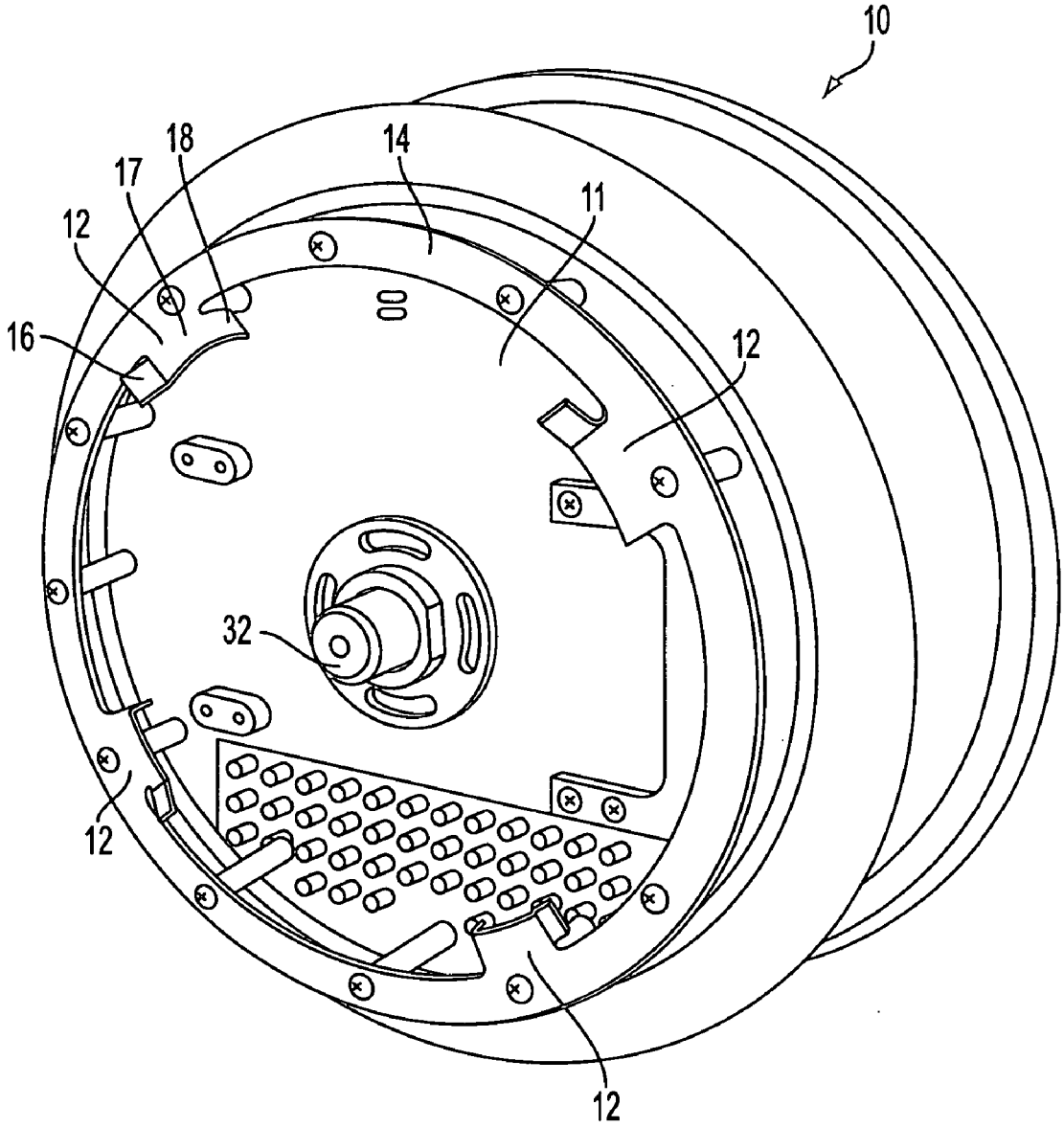
FIG. 2 is a three dimensional view of the radio.

Turning to FIG. 2, a radio locking ring 14 is attached to the radio mounting face 11. The locking ring 14 is attached to the radio 10, at a position displaced from the radio mounting face 11. A radio nose 32 extends from the center of the mounting face 11 in a direction perpendicular to the mounting face 11. Four radio locking tabs 12 are attached to the locking ring 14 at positions that are closer to the center of the radio, and therefore the radio nose 32, than the locking ring 14. These radio locking tabs 12, like the locking ring 14, are displaced a short distance away from the radio mounting face 11. The locking tabs 12 are preferably spaced equidistantly around the ring 14, although this is not critical to the invention.

In this embodiment, the diameter of the locking ring 14 is nine inches, which corresponds to an arc length of about 56.5 inches, and the distance between the radio locking tabs 12 that are across from each other is eight inches. Typically, the running length of each of the radio locking tabs 12 is from 15 degrees to 25 degrees of the ring's circumference in length, which for this embodiment is about between 2.3 and 4.0 inches. Naturally the invention is not intended to be limited to the specific dimensions.

As is shown in detail in FIG. 2, each radio locking tab 12 has a ramp portion 16, a body portion 17, and a stop portion 18. The ramp portion 16 begins at a position a distance from the radio mounting face 11 and preferably extends to a position that is the same distance away from the radio mounting face 11 as the locking ring 14; the main portion 17 begins at the position of the ramp portion 16 that is the same distance away from the radio mounting face 11 as the locking ring 14 and preferably extends in a direction substantially parallel to the mounting face 11 of the radio 10; and the stop portion 18 begins at the main portion and extends toward the radio at a direction substantially perpendicular to the radio mounting face 11.

Figure 3:
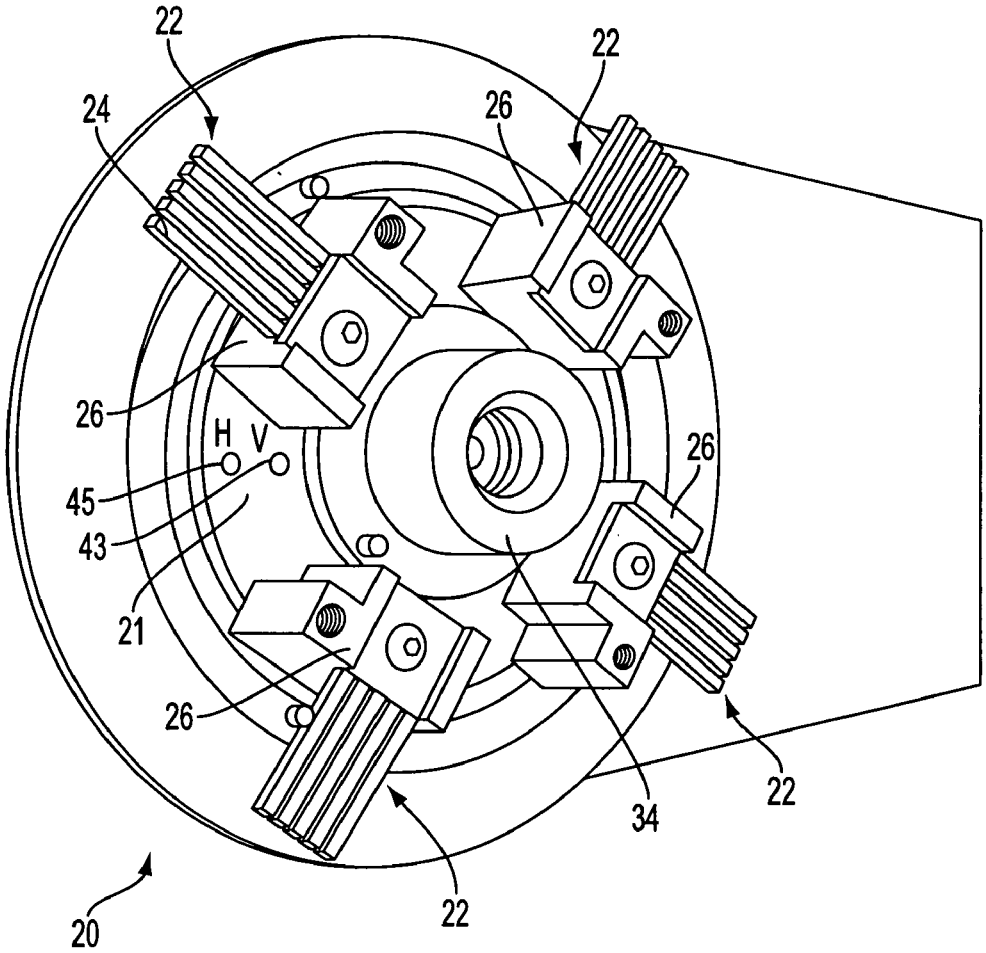
FIG. 3 is a three dimensional view of the antenna mounting face.

Turning to FIG. 3, an antenna feed input 34 is located in the center of the antenna mounting face 21. Four support pads 26 are located at positions the same distance away from the antenna feed input 34 and at equidistant radial positions around the antenna feed input 34. These support pads 26 retain four equidistantly spaced tension springs 22 a short distance from the antenna mounting face 21. The springs 22 include a plurality of individual cantilever spring fingers 24. The spring fingers 24 are parallel to the antenna mounting face, and extend from the support parts 26 away from the center of the antenna mounting face, and thus the antenna feed input 34. In this embodiment, rectangular fingers 24 with beveled edges are used; however, fingers 24 of other shapes, such as rods, corrugated bars, or V-shapes, can be used.

In a first embodiment of the invention, to mount the radio 10 to the antenna 20, the radio 10 is first located at a position that it is a offset from the desired locking position in a counterclockwise direction by a predetermined rotational value. This predetermined rotational value is equal to the previously described radio locking tab 12 running length, which is from 15 to 25 degrees in this embodiment. However, the invention is not limited in this respect.

Next, the radio 10 is pushed onto the antenna 20. It is important that the radio nose 32 be firmly engaged into the antenna feed input 34 at this time.

Figure 4:
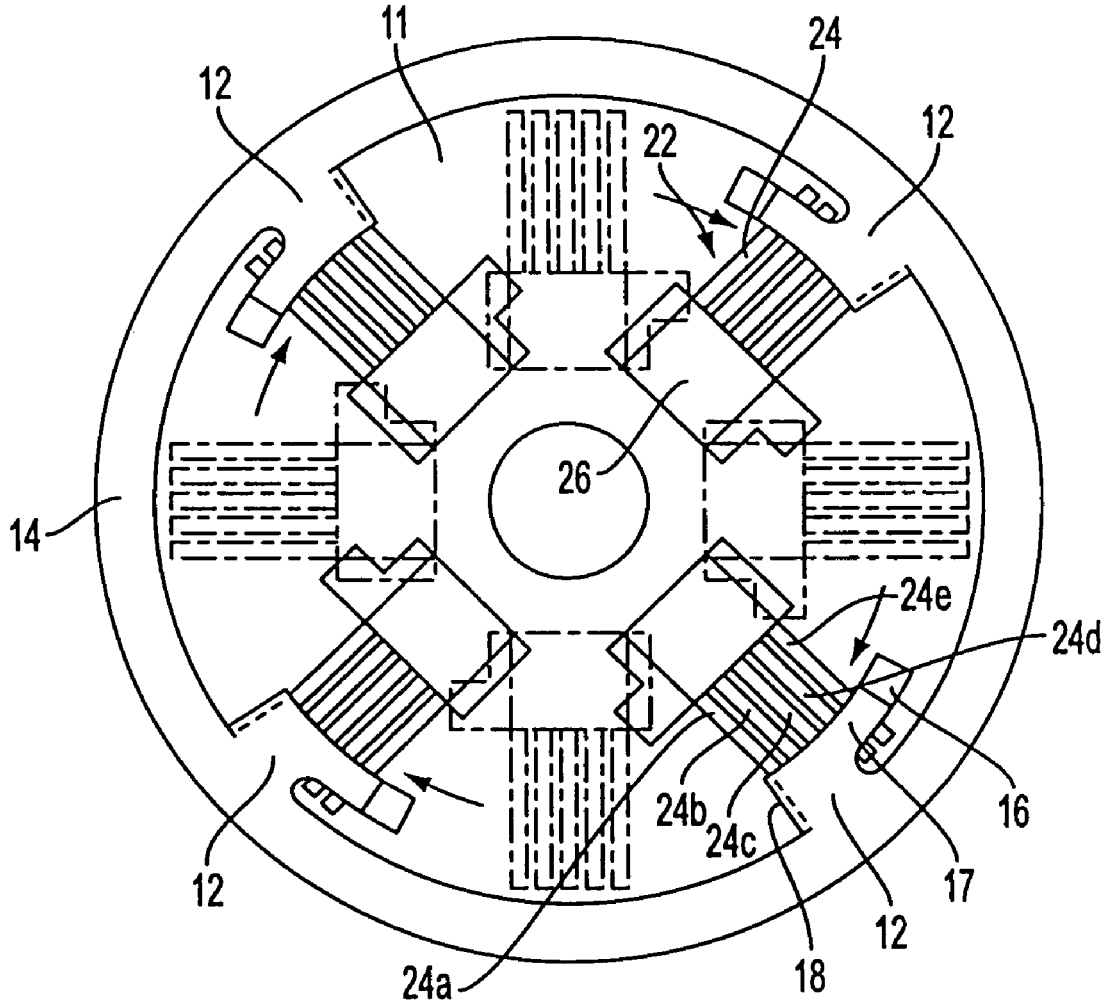
FIG. 4 is a view showing how the locking tabs and tension springs are secured together to provide deflection and friction forces.

Then, as is shown in FIG. 4, the radio 10 is turned clockwise. When the radio 10 is turned, the ramps 16 of the radio locking tabs 12 gradually deflect and guide the spring fingers 24 away from the antenna mounting face 21 and toward the radio mounting face 11 until they reach the secured stop 18 of the radio locking tabs 12.

As the radio is turned, the deflection and friction forces provided by each spring 22 is increased in steps. This occurs because each radio locking tab 12 first comes into contact with the closest spring finger 24*a*, which is deflected toward the radio mounting face 11 to provide deflection and friction forces. Next, a second spring finger 24*b* comes into contact with the radio locking tab 12 to provide a step increase in the deflection and friction forces. Thus, the deflection and friction forces increases step-wise as each additional finger 24*a*–24*e* comes into contact with the radio locking tab 12 and is deflected toward the radio mounting face 11 in the manner described with respect to the first spring finger 24*a*. This step increase in deflection and friction forces allows a user to overcome the deflection and friction forces of each spring finger 24 individually when turning the radio instead of having to overcome the entire sum of deflection and friction forces of a solid spring 22 at one time. Therefore, it is easier to mount the radio 10 to the antenna 20 using the individual spring fingers 24 than it would be with a one-piece tension spring.

Furthermore, as each individual spring finger 24 is gradually deflected closer to the radio mounting face by the ramp portion 16, the deflection and friction forces between the spring finger 24 and the radio locking tab 12 gradually increase. A maximum deflection and friction force sum is provided when all spring fingers 24 are at a position where they are deflected by the body portion 17 of the locking ring.

All of the spring fingers' 24 resistance to this deflection provides deflection and friction forces that secure the radio 10 to the antenna 20. In order to produce the desired deflection and friction forces, all four radio locking tabs 12 should preferably engage the four tension springs 22 on the antenna 20.

Rotating Locking Ring

In the first embodiment discussed above, the locking ring 14, on which the radio locking tabs 12 are located, is fixed to the radio 10. Consequently, as the ring 14 is rotated, the radio 10 is also rotated. In another embodiment, the ring 14' is rotatably attached to the radio 10'. This allows both the radio 10' and the antenna 20 to remain stationary as they are secured.

Figure 5A:
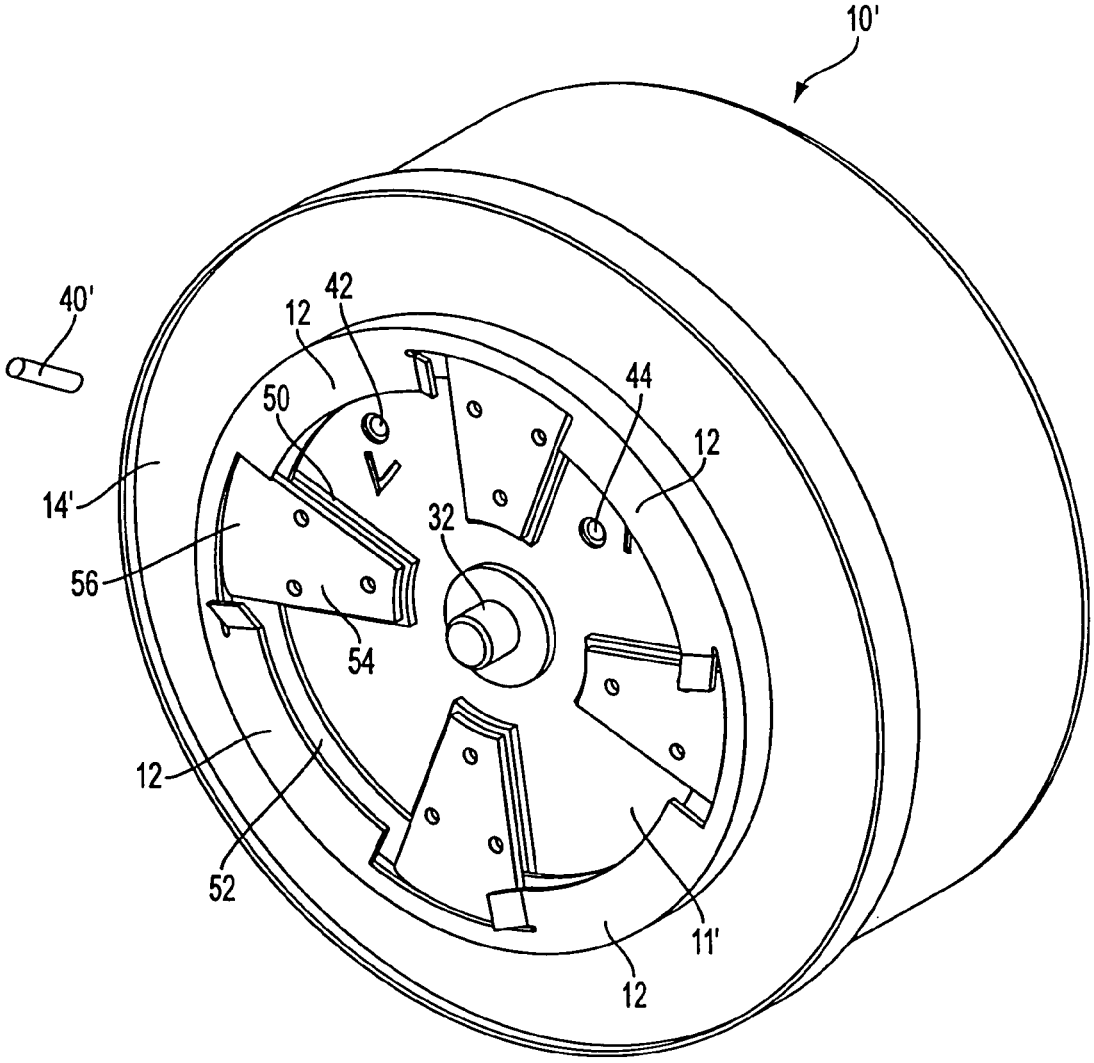
FIG. 5A is a three dimensional view of the radio with rotating locking ring and adaptation for the polarization pins on the radio.
Figure 5B:
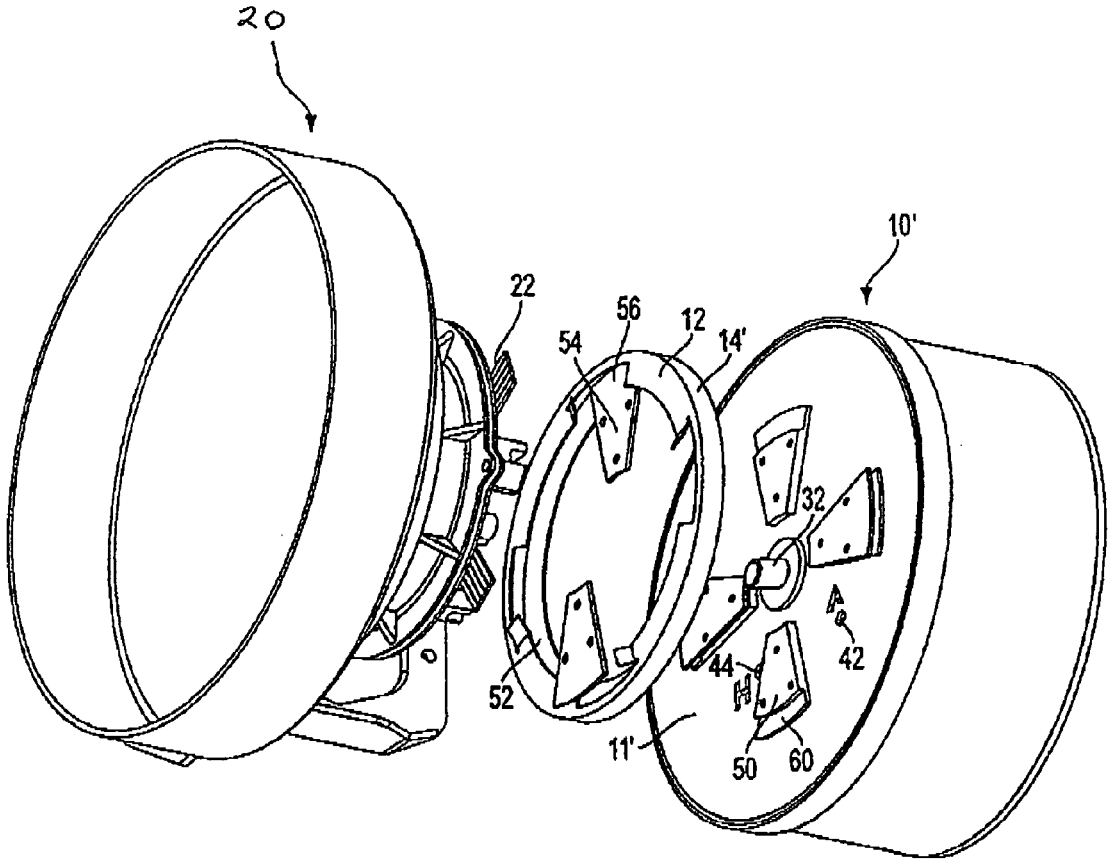
FIG. 5B is an expanded view of the radio with a rotating locking ring.

As shown in FIGS. 5A and 5B, in this embodiment, the radio mounting face has four bosses 50, each including a cut out portion 60. There are a corresponding number of ring tabs 54 that are respectively attached the bosses 50 leaving a gap corresponding to each of the cut-out portions 60. The locking ring 14' of this embodiment is a C-channel (i.e., in cross section), with an opening 52 that faces toward the radio nose 32. The inner flange of the C-channel is received in the respective gaps that are dimensioned to allow the ring 14' to rotate with respect to the radio 10'.

As in the previously described embodiment, the radio locking tabs 12 are located on the locking ring 14'. But in this embodiment, only the locking ring 14' needs to be rotated to bring the radio locking tabs 12, disposed on the ring 14, into contact with the spring fingers 24.

A variety of means for preventing the locking ring 14' from turning after the radio 10' has been mounted to the antenna 20 can be used, such as a bushing located on the face opposite the opening 52 in combination with a bar or pin, which is inserted into the bushing. Additionally, handles can be attached to the locking ring 14' to allow a user to more easily apply the torque needed to turn the locking ring 14'.

An additional advantage of this embodiment is that the direction of antenna polarization can be controlled by placement of a polarization pin 40 into either of two pinholes 42, 44 located on the radio mounting face 11' and either of two pinholes 43, 45 located on the antenna mounting face 21.

More specifically, the radio mounting face 11' has a first radio pinhole 42 that is located at a first predetermined distance from the center of the radio mounting face 11', and a second radio pinhole 44 that is a second distance from the center of the radio mounting face 11'. The first radio pinhole 42 is located at a position that is 90 degrees from the position where the second radio pinhole 44 is located.

Turning back to FIG. 3, the antenna mounting face 21 has a first antenna pinhole 43 that is located the first predetermined distance from the center of the antenna mounting face 21, and a second antenna pinhole 45 that is located at the second distance from the center the antenna mounting face 21. Unlike the radio pinholes 42, 44 with respect to the radio mounting face 11', the first antenna pinhole 43 is located at the same circumferential position as the second pinhole 45, with respect to the circumference of the antenna mounting face 21.

The placement of a polarization pin 40 into the first radio pinhole 42 and the corresponding antenna pinhole 43 provides a fixed alignment between the radio 10 and antenna 20 that provides antenna polarization in a vertical direction, while placement of a polarization pin 40 into the second pinhole 44 and the corresponding antenna pinhole 45 provides a fixed alignment between the radio 10 and antenna 20 that provides polarization in a horizontal direction.

The fact that the radio mounting face 11' does not rotate allows the pin 40 to be inserted into and aligned between both the radio mounting face 11', which is in a fixed position, and the antenna mounting face 21. The direction of antenna polarization cannot be controlled in this way in the first embodiment because the radio 10' is rotated in the first embodiment, and the radio mounting face 11' is not aligned in a fixed position with respect to the antenna mounting face 21 throughout the engagement of the radio locking tabs 12 and tension springs 22.

Design of the Components

In this embodiment, the tension springs 22 are made from stainless steel. Certain advantages provided by the use of stainless steel include corrosion resistance. In addition, the tension springs 22 can preferably be made from copper and beryllium, although the invention is not limited in this respect. It is also preferred that the locking ring 14 of the radio 10 be made of stainless steel to prevent corrosion caused by dissimilar metals, but the invention functions with a locking ring 14 made of other materials, such as, e.g., aluminum.

The design of the tension springs 22 controls the amount of deflection and friction forces provided by the springs 22, as well as the mounting's shock and vibration characteristics. The springs 22 can be manufactured by a standard stamping process and then heat treated after they are shaped and cut.

One can control sensitivity to tolerances by suitable selection of finger dimensional characteristics. The finger design also must be strong enough to withstand the compression forces applied to it as the ring is twisted into place. That is, as the fingers 24 of the spring 22 slide under the ramp 16, the fingers 24 must be strong enough to withstand the deflection and friction forces placed on it. As the ring 14 is rotated, the radio locking tabs 12 slide over the springs 22, deflecting the springs upward. The amount of deflection is usually less than 0.1 inches. In this embodiment, there is a 0.06 inch deflection. The shape and thickness of the springs affects the amount of deflection and friction forces applied to the radio 10. A general rule is that the thicker the springs 22 are, the greater the deflection and friction forces become. However, if the springs 22 are thicker, more torque is needed to twist-lock the ring 14. The individual springs 24 included in a single tension spring 22 can each have a different shape or thickness. Again, however, the specific dimensions of the spring are not critical to the invention and are not intended to be limiting.

In this embodiment, the spring 22 is 0.09 inches thick; however, a thickness from 0.05 to 0.15 inches has produced adequate results. In this embodiment, the length of the springs 22 is 1.5 inches although springs ranging in length from 0.5 to 1.5 inches have produced adequate results.

The amount of deflection force (F) required to deflect stainless steel is a cubic function of its thickness according to the equation:

$$F = \frac{\Delta 3EI}{L^3} \tag{1}$$

where Δ is the nominal deflection, E is the material property, I is the moment of inertia, and L is length of spring. For the springs of this embodiment:

$$I = \tfrac{1}{12} bh^3 \tag{2}$$

where b is width and h is thickness. The length (L) of the spring 22 is dependent on the size of the radio 10.

Friction limits the amount of deflection forces that can be applied to the radio 10. This is because friction between the radio locking tabs 12 and the tension springs 22 increases the torque required to twist the ring 14 into place. If the fingers 24 and/or the radio locking tabs 12 are coated, then the friction coefficient is reduced, and greater deflection forces can be applied. In this embodiment, both Teflon and molybdenum can be used as coatings to the springs 22.

Another way to decrease the torque required when mounting the radio 10 to the antenna 20, is by using radio locking tabs 12 with a longer running length along the ring's 14 circumference. This forms a shallower angle for introduction of the springs 22, which provides slower deflection rates of the spring fingers 24 and, thus, lower installation torques.

Although the Figures show tension spring 22 with five spring fingers 24, a greater or lesser number of spring fingers 24 may be used to control the magnitude of the friction and deflection forces.

It is of course understood that departures can be made from the preferred embodiment of the invention by those of ordinary skill in the art without departing from the spirit and scope of the invention that is limited only by the following claims. For example, the mounting system can be used to provide a secure connection between two housings that have similar structures to the antenna 20 and radio 10 structures described, or the springs 22 can provide compression by being gradually pushed or dragged, without a twisting or turning motion, into a mating position with the radio locking tabs 12.

What is claimed is:

1. A mounting device comprising:

a radio housing with a radio mounting face including:

a radio nose, and a locking ring that is rotatably attached to the radio mounting face; and an antenna housing with an antenna mounting face, including an antenna feed input, the locking ring being rotatable with respect to the antenna mounting face for being rotated into and out of a secured engagement with the antenna mounting face, with the radio nose being aligned with the antenna feed input, and the locking ring being attached and held next to the radio mounting face, able to rotate with respect to the radio mounting face, as the locking ring is rotated into and out of the secured engagement with the antenna mounting face.

2. The mounting device of claim 1, further comprising a plurality of ring tabs attached to the radio mounting face that are displaced from the radio mounting face;

wherein the radio mounting face has a center, wherein the locking ring is channel-shaped and is positioned adjacent to the radio mounting face, and the channel shaped locking ring has an opening that faces radially toward the center of the radio mounting face, and wherein the ring tabs extend radially away from the center of the radio mounting face and into the opening to hold the locking ring next to the radio mounting face.

3. A mounting device comprising:

a radio housing with a radio mounting face including:

a radio nose, and a locking ring that is rotatably attached to the radio mounting face; and an antenna housing with an antenna mounting face, including an antenna feed input, wherein:

the radio nose is aligned with the antenna feed input, the locking ring is secured to the antenna mounting face, the radio mounting face has a center, and the locking ring rotates about the center and includes a first pinhole at a first radio pinhole position located at a first distance from the radio mounting face center and a second pinhole at a second radio pinhole position located at a second distance from the radio mounting face center, the antenna mounting face has a center, and the locking ring rotates about the center and includes a first pinhole at a first antenna pinhole position located at the first distance from the antenna mounting face center and a second pinhole at a second antenna pinhole position located at the second distance from the antenna mounting face center, and placement of a pin in the first pinholes positions the antenna for a first polarization direction, or placement of the pin in the second pinholes positions the antenna for a second polarization direction.

4. The device of claim 3, wherein the radio mounting face has a circumference and the antenna mounting face has a circumference;

the first radio pinhole is located at a position that is 90 degrees, with respect to the circumference of the radio mounting face, from the second radio pinhole position where the second radio pinhole is located; and the first antenna pinhole and the second antenna pinhole are located at the same circumferential position with respect to the circumference of the antenna mounting face.

5. A mounting device comprising:

a radio housing including:

a radio mounting face, having a center, a plurality of ring tabs attached to the radio mounting face and displaced from the radio mounting face, a radio nose, and a locking ring that is rotatably attached to the radio mounting face, wherein the locking ring is channel-shaped and is positioned adjacent to the radio mounting face, and the channel shaped locking ring has an opening that faces radially toward the center of the radio mounting face, and wherein the ring tabs extend radially away from the center of the radio mounting face and into the opening to hold the locking ring next to the radio mounting face;

an antenna housing with an antenna mounting face, including an antenna feed input;

wherein the radio nose is aligned with the antenna feed input, and the locking ring is secured to the antenna mounting face, wherein the locking ring rotates about the center of the radio mounting face and includes a first pinhole at a first radio pinhole position located at a first distance from the radio mounting face center and a second pinhole at a second radio pinhole position located at a second distance from the radio mounting face center, and the antenna mounting face has a center, and the locking ring rotates about the center and includes a first pinhole at a first antenna pinhole position located at the first distance from the antenna mounting face center and a second pinhole at a second antenna pinhole position located at the second distance from the antenna mounting face center, wherein placement of a pin in the first pinholes positions the antenna for a first polarization direction, or placement of the pin in the second pinholes positions the antenna for a second polarization direction.

6. The device of claim 5, wherein the radio mounting face has a circumference and the antenna mounting face has a circumference;

the first radio pinhole is located at a position that is 90 degrees, with respect to the circumference of the radio mounting face, from the second radio pinhole position where the second radio pinhole is located; and the first antenna pinhole and the second antenna pinhole are located at the same circumferential position with respect to the circumference of the antenna mounting face.

* * * * *